United States Patent [19]

Yanagihara et al.

[11] Patent Number: 4,955,189

[45] Date of Patent: Sep. 11, 1990

[54] WORSTED YARN-LIKE FALSE-TWISTED YARN

[75] Inventors: Masaaki Yanagihara, Ehime; Katsutoshi Taniguchi; Muneaki Awata, both of Matsuyama, all of Japan

[73] Assignee: Teijin Limited, Osaka, Japan

[21] Appl. No.: 381,731

[22] PCT Filed: Nov. 11, 1988

[86] PCT No.: PCT/JP88/01142

§ 371 Date: Jul. 5, 1989

§ 102(e) Date: Jul. 5, 1989

[87] PCT Pub. No.: WO89/04389

PCT Pub. Date: May 18, 1989

[30] Foreign Application Priority Data

Nov. 12, 1987 [JP] Japan ..... 62-284362

[51] Int. Cl.[5] ..... D02G 3/24; D02G 1/02; D02G 3/26; D02G 3/34

[52] U.S. Cl. ..... 57/207; 57/205; 57/208; 57/245; 57/247; 57/288; 57/908; 428/370; 428/373

[58] Field of Search ..... 57/205, 207, 204, 208, 57/245–247, 287, 288, 350, 908; 428/369, 370, 373, 375

[56] References Cited

U.S. PATENT DOCUMENTS

| | | | |
|---|---|---|---|
| 3,577,873 | 5/1971 | Waters | 57/205 |
| 3,691,750 | 9/1972 | Waters | 57/205 |
| 4,296,597 | 10/1981 | Tani et al. | 57/205 |
| 4,307,565 | 12/1981 | Sasaki et al. | 57/207 X |
| 4,365,466 | 12/1981 | Horiuchi et al. | 57/288 X |

FOREIGN PATENT DOCUMENTS

| | | |
|---|---|---|
| 55-98931 | 7/1980 | Japan . |
| 61-19733 | 5/1986 | Japan . |
| 62-110936 | 5/1987 | Japan . |
| 62-141142 | 6/1987 | Japan . |

*Primary Examiner*—John Petrakes

*Attorney, Agent, or Firm*—Burgess, Ryan & Wayne

[57] ABSTRACT

Disclosed is a worsted yarn-like false-twisted yarn composed of large-denier multifilaments having a thickness of at least 4 de and small-denier multifilaments having a thickness of 0.7 to 2 de, which comprises (a) alternately twisted yarn-like wrapped portions in which a covering (sheath) composed of the small-denier filaments is wound substantially in the bundled state on a core composed of the large denier filaments, (b) open portions in which a covering composed of the small-denier filaments which are opened to one another covers a core composed of the large-denier filaments substantially in parallel to the yarn axis in the alternately reversed state, and (c) entangled portions in which the large-denier filaments and small-denier filaments are entangled with one another, wherein (d) bundled portions are formed from the alternately twisted yarn-like wrapped portions and the entangled portions, (e) the length L1 of the open portions is at least ½ of the length L2 of the bundled portions, and (f) in the unit length of the false-twisted yarn, the length of the small-denier filaments is larger than the length of the large-denier filaments by 13 to 25% based on the length of the large-denier filaments.

10 Claims, 3 Drawing Sheets

WORSTED YARN-LIKE FALSE-TWISTED YARN

TECHNICAL FIELD

The present invention relates to a worsted yarn-like false-twisted yarn. More particularly, the present invention relates to a worsted yarn-like false-twisted yarn having a high resilience while showing a soft touch.

BACKGROUND ART

As the conventional false-twisted yarn having a soft touch and an appropriate resilience, there is known a mixed filament false-twisted yarn comprising at least two kinds of filaments having a different denier and having entangled portions appearing intermittently in the longitudinal direction thereof, in which large-denier filaments form mainly a core portion and small-denier filaments form mainly a sheath portion (see, for example, Japanese Examined Patent Publication No. 47-18060, Japanese Examined Patent Publication No. 60-22092, and Japanese Unexamined Patent Publication No. 55-112325).

In this false-twisted yarn, a bundling property is given by such entangled portions and a bulkiness is given by open portions located between two adjacent entangled portions. Although this processed yarn has a soft touch, the resilience is poor and the touch is different from that of a worsted yarn-like processed yarn.

A false-twisted yarn having a worsted yarn-like touch, in which the touch of the above-mentioned mixed filament false-twisted yarn is improved, is proposed in, for example, Japanese Examined Patent Publication No. 61-19733 and Japanese Unexamined Patent Publication No. 55-98931. This yarn is a false-twisted yarn having a two-layer structure, in which filaments having a smaller denier are substantially continuously wrapped around larger-denier filaments constituting mainly the core in the form of an alternately twisted yarn.

A fabric formed by using this type of alternately twisted yarn-like processed yarn has both a soft touch like that of a worsted fabric and a good resilience. Especially, a thick woven fabric having a weight of at least 200 g/m$^2$ is suitable for use as a material of a product for autumn and winter wear because the fabric has a warm feel in addition to the above-mentioned characteristics.

To obtain the same effects as found in the above-mentioned thick woven fabric by applying this alternately twisted yarn-like processed yarn to a medium-thickness woven fabric having a weight of 100 to 150 g/m$^2$ (hereinafter referred to as "medium-thickness woven fabric"), the demand for which is now increasing, the inventors used small-denier filaments as the constituent filaments, and as a result and contrary to our expectations, we found that the obtained medium-thickness woven fabric had an extremely poor resilience and bulkiness.

To overcome this defect, we varied the thickness in the large-denier filaments and/or small-denier filaments and prepared various, alternately twisted yarn-like processed yarns, but a worsted fabric-like medium-thickness woven fabric having a soft touch, a good bulkiness, and a satisfactory resilience could not be prepared from these processed yarns.

DISCLOSURE OF THE INVENTION

Therefore, a primary object of the present invention is to provide a worsted yarn-like false-twisted yarn which is suitable for the formation of a worsted fabric-like medium-thickness woven fabric having a soft touch, a good bulkiness, and an appropriate resilience.

The inventors carried out research with a view to attaining this object, and found that a false-twisted yarn in which alternately twisted yarn like wound portions are intermittently formed in the longitudinal direction, and entangled portions where constituent filaments are tightly entangled and open portions where constituent filaments are arranged without being restrained by one another, appear among the alternately twisted yarn-like wrapped portions, gives a worsted fabric-like medium-thickness woven fabric having a soft touch, a good bulkiness, and an appropriate resilience, and the present invention is based on this finding.

More specifically, in accordance with the present invention, there is provided a worsted yarn-like false-twisted yarn composed of at least two kinds of multifilaments differing in the denier, which yarn simultaneously satisfies (I) the requirement that the thickness of the large-denier filaments should be at least 4 de and (II) the requirement that the thickness of the small-denier filaments should be 0.7 to 2 de, which comprises bundled portions including alternately twisted yarn-like wrapped portions, entangled portions, and open portions, alternately arranged along the longitudinal direction of the yarn, and wherein (A) in the alternately twisted yarn-like wrapped portions, a covering composed mainly of the small-denier filaments is wrapped substantially in the bundled state on a core composed mainly of the large-denier filaments, (B) in the open portions, a covering composed mainly of the small-denier filaments which are opened to one another, covers a core composed mainly of the large-denier filaments substantially in parallel to the yarn axis in the successively reversed state, (C) the length (L1) of the open portions is at least ½ of the length (L2) of the bundled portions, and (D) in the unit length of the false-twisted yarn, the small denier filaments are longer than that of the large-denier filaments and the difference in length between the small-denier filaments and the large-denier filaments is 13 to 25% based on the length of the large-denier filaments.

BEST MODE OF CARRYING OUT THE INVENTION

The false-twisted yarn (sometimes referred to as "processed yarn" hereinafter) will now be described in detail with reference to the accompanying drawings.

Figure 1A:
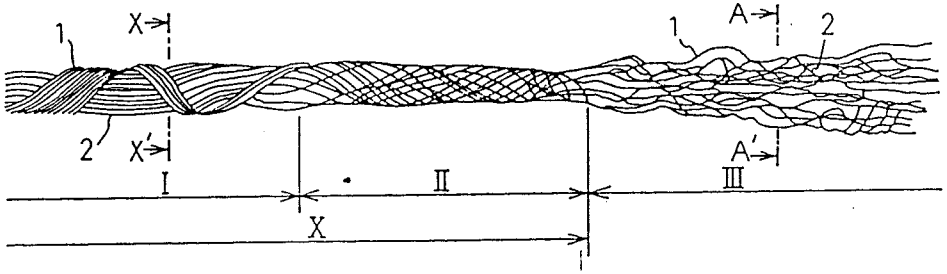
FIGS. 1-(*a*) and 1-(*b*) are side views illustrating the false-twisted yarn of the present invention.
Figure 1B:
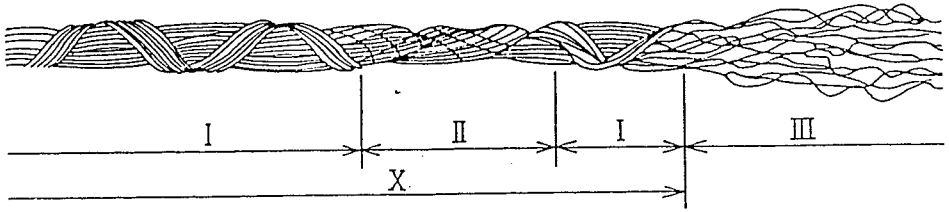
Figure 2A:
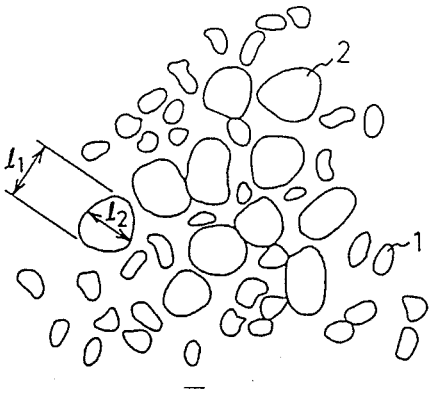
FIGS. 2-(*a*) and 2-(*b*) are views showing cross-sections taken along the planes A-A' and X-X' of the processed yarn shown in FIG. 1-(*a*), respectively.
Figure 2B:
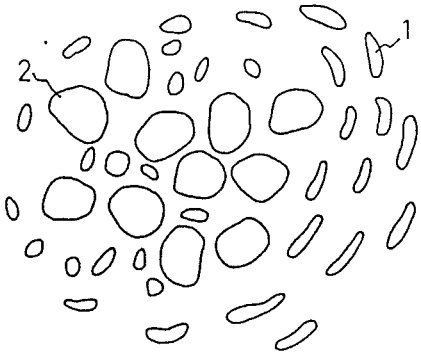
Figure 3:
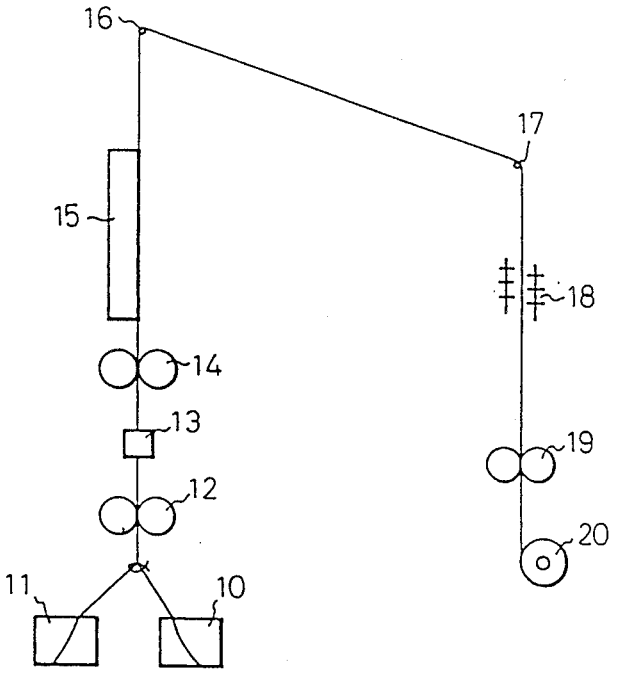
FIG. 3 is a diagram illustrating an embodiment of the apparatus for preparing the false-twisted yarn of the present invention.

FIGS. 1-(*a*) and 1-(*b*) show examples of the side configuration of the false-twisted yarn of the present invention, and FIGS. 2-(*a*) and 2-(*b*) show the shapes of the cross-sections taken along the planes A-A' and X-X' of FIG. 1-(*a*), respectively, FIG. 3 illustrates an embodiment of the apparatus for preparing the false-twisted yarn of the present invention.

Referring to FIGS. 1-(*a*) and 1-(*b*), I represents an alternately twisted yarn-like wrapped portion, II represents an entangled portion and III represents an open portion, and X represents a bundled portion comprising the alternately twisted yarn-like wrapped portion I and the entangled portion II. In FIGS. 1 and 2, filaments constituting mainly the cover (sheath) are represented by reference numeral 1 and filaments constituting mainly the core are represented by reference numeral 2 in the alternately twisted yarn-like wrapped portion I and the open portion III.

The processed yarn of the present invention is composed of at least two kinds of filaments having a different denier, and as shown in FIG. 1, the bundled portions X including the alternately twisted yarn-like wrapped portions I and entangled portions II, and the open portions III, are alternately formed along the longitudinal direction.

In the bundled portion X of the processed yarn of the present invention, as shown in FIGS. 1-(*a*), 1-(*b*) and 2-(*b*), at least one kind of small-denier filaments 1 are wrapped substantially in the bundled state on the core composed mainly of at least one kind of large-denier filaments 2. In the entangled portion II, the large-denier filaments 2 and small-denier filaments 1 are tightly entangled with one another in the mixed filament state. The bundled portion X is constructed by the alternately twisted yarn-like wrapped portion I and entangled portion II, which are connected to each other.

In this bundled portion X, the entangled portion II has a large cross-sectional secondary moment because the yarn as a whole is tightly compacted and the cross-section of the yarn is relatively circular, and the entangled portion II gives a high resilience to a finally obtained fabric.

The alternately twisted yarn-like wrapped portion I has a puff (bulkiness), compared with the entangled portion II, and gives an elasticity to compression, whereby a worsted fabric-like touch can be given to the resultant fabric.

As shown in FIGS. 1-(*a*), 1-(*b*) and 2-(*a*), the open portion III adjacent to the bundled portion X comprises a core composed mainly of large-denier filaments 2 and a covering composed mainly of small-denier filaments 1 which are opened to one another, said covering wraps the core substantially in parallel to the yarn axis in the successively reversed state, and the open portion gives an increased bulkiness and softness, which are insufficient in the bundled portion, to the resultant fabric.

The length (L1) of the open portion III must be at least ½ (preferably 0.9 to 2 times) of the length (L2) of the bundled portion X.

If the length (L1) of the open portion III is smaller than ½ of the length (L2) of the bundled portion X, it is impossible to impart a desired high bulkiness and softness resembling those of a worsted fabric to the finally obtained processed yarn fabric.

At least two kinds of filaments having a different denier which constitute the processed yarn of the present invention, must simultaneously satisfy the following requirements (i) and (ii):

(i) The thickness of the large-denier filaments is at least 4 de (preferably 4.5 to 5.5 de).

(ii) The thickness of the small-denier filaments is 0.7 to 2 de (preferably 1.0 to 1.5 de).

As shown in FIGS. 2-(*a*) and 2-(*b*), in the alternately twisted yarn-like wrapped portion I and the open portion III, the core serves mainly as a tension support, and when the core is composed mainly of large-denier filaments 2 having a thickness of at least 4 de, this core as well as the entangled portion II imparts a high resilience to the resultant fabric. In contrast, since the covering (sheath) is composed of small-denier filaments having a thickness of 0.7 to 2 de, the covering as well as the open portion gives a required softness to the resultant fabric.

In the unit length of the processed yarn of the present invention, the length of the small-denier filaments 1 is larger than the length of the large-denier filaments 2, and the difference in the length is 13 to 25% (preferably 15 to 20%) based on the length of the large-denier filaments.

In the unit length of the processed yarn of the present invention, the difference in the filament length is expressed as filament length difference and is measured by the method disclosed in Japanese Examined Patent Publication No. 58-18457.

If the filament length difference in the processed yarn of the present invention is smaller than 13%, the proportion of the formed alternately twisted yarn-like wrapped portion in the entire processed yarn is greatly reduced, and the medium-thickness woven fabric prepared from this processed yarn does not have a worsted fabric-like touch. In the processed yarn having a filament length difference exceeding 25%, the proportion of the alternately twisted yarn-like wrapped portion I in the entire processed yarn is greatly increased, and thus the proportion of the open portion III is reduced, with the result that the touch of the medium-thickness woven fabric prepared from this processed yarn has an extremely poor resilience and bulkiness.

In the processed yarn of the present invention, preferably a cross-sectional flatness of the large-denier filaments is lower than 1.5 (especially 1.15 to 1.45), and the cross-sectional flatness of the small-denier filaments is higher than that of the large-denier filaments (especially 2.0 to 2.4).

The cross-sectional flatness referred to herein means the ratio (l1/l2) of the length (l1) of the major axis of the flat section to the length (l2) of the minor axis of the flat cross-sectional profile, as shown in FIG. 2-(*a*). The closer to 1 the cross-sectional flatness, the closer to a circle the cross-sectional profile.

In general, if the filament cross-section is flattened, the cross-sectional secondary moment of the filament is decreased, and the filament is easily deformable by an external force.

Accordingly, if the cross-sectional profile, of the large-denier filaments serving as the tension support is made as close to a shape of a true circle as possible, the resilience of the processed yarn and a fabric prepared from this processed yarn is further improved. Furthermore, if the cross-sectional profile of the small-denier filaments constituting mainly the covering (sheath) is flattened, the softness of the obtained processed yarn and a fabric prepared from the processed yarn is further improved.

The recurring unit comprising the bundled portion X and the open portion III, which is arranged along the longitudinal direction of the processed yarn, can have an arrangement order of alternately twisted yarn-like wrapped portion I/entangled portion II/open portion III (type A), as shown in FIG. 1-(*a*), or an arrangement order of alternately twisted yarn-like wrapped portion I/entangled portion II/interlaced and wrapped portion I/open portion III (type B), as shown in FIG. 1-(*b*). In the processed yarn, recurring units of types A and B may be present in the mingled state.

To maintain a good balance between the effects of the bundled portion X and open portion III in the processed yarn of the present invention, preferably the number of the bundled portions X consisting of the alternately twisted yarn-like wrapped portion I and the entangled portion II is 40 to 80 per meter, and the ratio (m1/m2) of the number (m2) of the bundled portions X to the number (m2) of the open portions III is in the range of from 0.6 to 1.4.

Also, preferably in the alternately twisted yarn-like wrapped portion II, the large-denier filaments 2 constituting mainly the core and the small-denier filaments constituting mainly the covering (sheath) are mingled and entangled with one another in the boundary between the core and the covering (sheath), as shown in FIG. 2-(*b*). In this case, the stability against "squeezing (scratching)" at the processing and weaving steps can be greatly improved.

Moreover, preferably in the open portion III, the crimp wavelength of the small-denier filaments 1 is 0.5 to 1.5 mm. In this case, the softness of the resultant fabric can be further improved.

The crimp wavelength referred to herein is a crimp wavelength (distance between two adjacent peaks or troughs of crimps) of the small-denier filaments of the open portion, measured from a photograph of the side face of the processed yarn taken at a magnification of 36 by an optical microscope.

Preferably, the ratio (f1/f2) of the number (f1) of the large-denier filaments 2 constituting the processed yarn of the present invention to the number (f2) of the small-denier filaments 1 is from 1/10 to ½, and the Young's modulus of the processed yarn as a whole is 250 to 450 $kg/mm^2$. In this case, the resilience of the finally obtained processed yarn fabric can be further improved.

When a medium-thickness woven fabric having a weight of 100 to 150 $g/m^2$ is prepared by using the above-mentioned processed yarn of the present invention, preferably the total denier of the processed yarn is smaller than 200 de, especially 80 to 180 de.

Preferably, the polymer constituting the filaments of the processed yarn of the present invention is a thermoplastic polymer, but a polyester, especially polyethylene terephthalate, is more preferable.

Filaments to which various functions have been imparted can be used as the small-denier filaments and/or large-denier filaments constituting the processed yarn of the present invention, and use of such filaments is more preferable. Examples of such functions are described below.

(1) ANTISTATIC PROPERTY

A filament formed by using a filament-forming polymer in which an insoluble polyoxyalkylene glycol and a metal salt of an alkyl sulfonate represented by the formula $RSO_3M$ in which R stands for an alkyl group having at least 8 carbon atoms and M stands for an alkali metal are incorporated is used as the filament. Preferably the content of the polyoxyalkylene glycol is 0.1 to 10% based on the weight of the polymer and the content of the metal alkyl-sulfonate is 0.2 to 10% based on the weight of the polymer. Also, preferably the filament is a hollow filament.

(2) ELECTROCONDUCTIVITY

A core-in-sheath type composite filament comprising an electroconducting agent arranged in the core, as disclosed, for example, in Japanese Examined Patent Publication No. 60-21553, is used.

(3) WATER-ABSORBING PROPERTY

A filament comprising a fine pore-forming agent, as known, for example, from Japanese Unexamined Patent Publication No. 56-20612, in which fine pores are arranged in the longitudinal direction, the diameter of the fine pores is 0.01 to 3 μm and the length is smaller than 50 times the diameter is used. Use of a hollow filament having fine pores connected to the hollow portion is preferable for further improving the waterabsorbing property.

(4) DYEING BRIGHTNESS

A filament in which a fine pore-forming agent is incorporated to form fine pores having a diameter of 0.1 to 0.3 μm and arranged in the longitudinal direction, as is known from Japanese Unexamined Patent Publication No. 54-120728 or Japanese Unexamined Patent Publication No. 57-25414, is used.

(5) DYEABILITY

A filament composed of a polymer in which a dyeability-improving agent such as a 5-sulfoisophthalic acid component is copolymerized in an amount of about 1 to about 10 mole% based on the recurring units of the polymer is used.

Furthermore, an easy-dyeable filament as disclosed in Japanese Unexamined Patent Publication No. 57-199814 can be used.

A combination of a filament having an improved dyeability and a filament having a different dyeability, for example, a combination a cationic dye-dyeable filament copolymerized with a 5-sulfoisophthalic acid and a disperse dye-dyeable filament, can be used in the mixed filament state.

(6) ELASTICITY

A filament of a filament-forming elastic polymer such as polybutylene terephthalate is used. Preferably, this elastic filament is used as the largedenier filament.

Note, the above-mentioned functional filaments are shown only for illustration, and functional filaments that can be used are not limited to those exemplified above.

The above-mentioned processed yarn of the present invention can be prepared by using a highly oriented yarn (USY) and a partially oriented yarn (POY) simultaneously satisfying the following requirements (1) through (3) as starting yarns, for example by the false-twisting process shown in FIG. 3.

(1) USY
Birefringence (Δn): 0.07 to 0.1 (preferably 0.08 to 0.09)

(2) POY
Birefringence (Δn): 0.025 to 0.05 (preferably 0.03 to 0.04)

(3) Difference in Ultimate Elongation
50 to 150% (preferably 80 to 120%)

Referring to FIG. 3, USY 11 and POY 10 are doubled and then supplied to an interlacing nozzle 13 where the doubled yarn is entangled, and the doubled yarn is false-twisted while being drawn at a draw ratio of 1.1 to 1.4 between a feed roller 14 and a delivery roller 9. Finally, the yarn is wound on a winder 20.

At this false-twisting step, the yarn which has passed through a heater 15 maintained at a temperature of 150° to 180° C. is subjected to "squeezing (scratching)" while being bent by guide pins 16 and 17. Then, the yarn is twisted and untwisted by a false-twisting member 18. At this false-twisting step, preferably the twisting tension (T1) is maintained at 50 to 50 g/150 de (ordinarily about 45 g/150 de) and the ratio (T2/T1) of the untwisting tension (T2) to the twisting pressure (T1) is from 0.7 to 0.9.

At the false-twisting step, if the heater temperature is higher than 180° C. or the yarn is not subjected to "squeezing (scratching)", the proportion of the alternately twisted yarn-like portion I becomes too large in the obtained processed yarn and the resultant yarn is substantially an alternately twisted yarn-like wrapped yarn as a whole. If the heater temperature is lower than 150° C., formation of the alternately twisted yarn-like wrapped portion I becomes difficult.

If the T2/TI ratio is lower than 0.7, formation of the open portion III in the resultant processed yarn becomes difficult, and if the T2/T1 ratio exceeds 0.9, formation of the alternately twisted yarn-like wrapped portion I in the resultant processed yarn becomes difficult.

In the above-mentioned false-twisting process, a frictional false-twisting member capable of performing high-speed processing is preferably used as the false-twisting member 18.

"Squeezing (scratching)" is not particularly limited to scratching by the guide pins 16 and 17, and it will be understood that it is sufficient if a corresponding scratching operation is effected between the heater 15 and the false-twisting member 18.

A false-twisting process similar to the above-mentioned false-twisting process in the filamentary yarns used is disclosed in Japanese Unexamined Patent Publication No. 59-173322 and Japanese Unexamined Patent Publication No. 61-174436.

The processed yarn obtained according to the false-twisting process disclosed in these patent publications is an alternately twisted yarn-like two-layer yarn per se and is quite different from the processed yarn of the present invention in which the alternately twisted yarn-like wrapped portions capable of exhibiting a worsted yarn-like touch are present in combination with entangled portions and open portions.

Moreover, in the false-twisting process disclosed in the above-mentioned patent publications, a falsetwisting temperature (false-twisting temperature) of 200° C., which is much higher than the false-twisting temperature necessary for obtaining the processed yarn of the present invention, is adopted. In the abovementioned patent publications, it is not taught that, as in the present invention, the twisting tension (T1) is increased by "squeezing (scratching)" the yarn which has passed through the heater maintained at a temperature lower than 200° C. and the T2/T1 ratio is maintained within the range of from 0.7 to 0.9.

The alternately twisted yarn-like wrapped portion I, entangled portion II and open portion III of the worsted yarn-like false-twisted yarn of the present invention and the specific filaments used in the present invention exert the following functions and effects.

Alternately Twisted Yarn-like Wrapped Portion I

This portion exhibits an increased elasticity against compression, and gives a worsted fabric-like touch to a fabric formed from the processed yarn.

Entangled Portion II

Since the constituent filaments are tightly entangled with one another, the yarn as a whole is compact, and since the cross-section of this portion is relatively circular, the cross-sectional secondary moment of this portion is large and a high resilience can be given to the resultant fabric. Moreover at the weaving step, the processed yarn can be supplied to a water jet loom in the untwisted and paste-free state.

Open Portion III

Since the constituent filaments are opened and arranged in parallel without being restrained by another, a very soft touch can be imparted to the resultant fabric.

Use of Specific Filaments Differing in Denier

By using at least two kinds of filaments having a specific denier and adjusting the filament length difference within a predetermined range, the softness and resilience of the resultant fabric can be improved.

In the processed yarn of the present invention, by the combination of the above-mentioned functions and effects attained by the formation of the alternately twisted yarn-like wrapped portion I, entangled portion II and open portion III and the use of specific filaments, the touch of the resultant fabric is improved, and as a result, a worsted yarn-like processed yarn and a fabric thereof, which are soft and have a good bulkiness and a high resilience, can be obtained.

EXAMPLES

The present invention will now be described in detail with reference to the following examples.

Note, in the following examples, the frictional charge voltage, dust adherence, and dust-removing property of the false-twisted yarn fabric were determined by the following methods.

(1) Frictional Charge Voltage

(i) Apparatus and Material

A rotary drum type frictional charge quantity measuring-apparatus (rotary static tester), an oscilloscope, and a rubbing cloth of cotton broadcloth 30/− (scored, bleached, and paste-free-finished) were used.

(ii) Preparation of Test Pieces

Three each of roll-up type test pieces having a size of 3.8 cm × 3.0 cm and metal frame type test pieces having a size of 4.0 cm × 8.0 cm were collected, and three longitudinal fabric pieces having a size of 2.5 cm × 14.0 cm were collected from cotton broadcloth (30/−).

(iii) Test Procedures (1) Conditioning: Allowed to stand in a dessicator at 65±2% RH for at least 24 hours
(2) Atmosphere in Measuring Chamber: 20=2° C. and 65±2% RH
(3) Specimen: 1
(4) Drum Rotation Number: 700 r.p.m.
(5) Charge Equilibriation Time: 1 minute
(6) Contact Pressure Load: 600 g A specimen was attached to the rotary drum of the rotary static tester so that the front side face of the specimen was located above, and one rubbing cloth was attached, in parallel to the specimen, to clips on both ends of the lower part of the tester at the position coming into contact with the specimen, and a load of 600 g was imposed on the rubbing cloth. The tester was operated in the order of the recorder (5 cm/min)-rotary drum-oscilloscope, and when charging was equilibriated, the frictional charge voltage (V) and the polarity value (±,−) were read. The mean value of the results obtained with respect to three test pieces was calculated (up to 10 integer figures).

When the relationship between the antistatic effect and the frictional charge voltage was examined, it was found that an antistatic effect can be obtained if the frictional charge voltage is lower than 2000 V (preferably lower than 1000 V).

(2) Dust Adherence

The specimen was allowed to stand in a room for two weeks, and the degree of adhesion of dust was organoleptically evaluated by naked eye observation. The test piece where the adherence of dust was extreme was judged as class 1 or 2, the specimen where the adhesion of dust was very small was judged as class 4 or 5, and the specimen where the adherence of dust was intermediate was judged as class 3.

(3) Dust-Removing Property

The ease of removal of dust adhered to the specimen which had been allowed to stand in a room for two weeks was organoleptically evaluated by naked eye observation. The specimen from which dust was very easily removed was judged as class 4 or 5, the specimen where the removal of dust was very difficult was judged as class 1 or 2, and the specimen where the ease of removal of dust was intermediate was judged as class 3.

EXAMPLE 1

Polyethylene terephthalate having an intrinsic viscosity [η] of 0.64 was melt-spun and a partially oriented yarn (POY) of 115 de/72 fil was prepared at a spinning speed of 2500 m/min. Furthermore, a highly oriented yarn (USY) of 76 de/12 fil was prepared at a spinning speed of 4500 mm/min.

The obtained POY and USY were false-twisted by the process shown in FIG. 3.

The physical properties of POY and USY used as the starting yarns and the false-twisting conditions are shown in Table 1.

Note, a three-axis circumscribed false-twisting member was used as the false-twisting member.

TABLE 1

| Filaments | | | | | False-Twisting Conditions | | | | | |
|---|---|---|---|---|---|---|---|---|---|---|
| POY | | USY | | Elongation Difference (%) | Number of Entanglements (number/m) | Heater Temperature (°C.) | Draw ratio | $T_2/T_1$ | Processing Speed (m/min) | Material, Roughness and Diameter of Guides 16 and 17 |
| Δn | Ultimate elongation | Δn | Ultimate elongation | | | | | | | |
| 0.032 | 190% | 0.086 | 82 | 108 | 55 | 180 | 1.32 | 0.82 | 600 | titanium, 0.2 to 1.05, 10 mm |

Note
T1: twisting tension
T2: untwisting tension

When the obtained false-twisted yarn was observed by a microscope, it was found that the false-twisted yarn had mainly the structure shown in FIG. 1 (the structure of the arrangement order of alternately twisted yarn-like wrapped portion I — entangled portion II — open portion III). Also the structure of the arrangement order of interlaced and wrapped portion I — entangled portion — interlaced and wrapped portion I — open portion III was partially observed, although the appearance was in frequent.

The physical properties of the obtained falsetwisted yarn are shown in Table 2.

TABLE 2

| Thick-Denier Filaments | | Fine-Denier Filaments | | Yarn Leg Difference | Young's Modulus | | $M_1$ (number/m) | | Crimp Wavelength of Open Portion (III) |
|---|---|---|---|---|---|---|---|---|---|
| de | Flatness | de | Flatness | (%) | (kg/mm²) | $L_1/L_2$ | | $M_2/M_1$ | (mm) |
| 4.7 | 1.3 | 1.2 | 2.1 | 18 | 350 | 0.95 | 55 | 0.70 | 0.68 |

Note
L1: length of open portion III
L2: total length of alternately twisted yarn-like wrapped portion I and entangled portion II
M1: number of alternately twisted yarn-like wrapped portions I and entangled portions II
M2: number of open portions III The section of the open portion III of the false-twisted yarn was as shown in FIG. 2-(*a*), and the section of the alternately twisted yarn-like wrapped portion I was as shown in FIG. 2-(*b*).

The obtained false-twisted yarn was supplied in the untwisted and paste-free state to a water jet loom and a plain weave fabric having a basis weight of 135 g/m² was prepared. The plain weave was dyed by customary procedures, and the performance was organoleptically tested. It was found that the obtained weave fabric was soft and had a good bulkiness, and an appropriate resilience and a touch like that of a worsted fabric.

EXAMPLES 2 THROUGH 4 AND COMPARATIVE EXAMPLES 1 THROUGH 5

The procedures of Example 1 were repeated in the same manner except that the Δn and elongation of the starting filaments, and the false-twisting conditions, were changed as shown in Table 3. The characteristics of the resultant yarns and fabrics are shown in Table 3.

TABLE 3

| | Starting Yarns | | | | False-Twisting Conditions | | | | | | | | False-Twisted Yarns | | | | | | |
|---|---|---|---|---|---|---|---|---|---|---|---|---|---|---|---|---|---|---|---|
| | POY | | USY | | | | | | Large Denier Filaments | | Small-Denier Filaments | | | | | | | | |
| | Δn | Ultimate Elongation (%) | Δn | Ultimate Elongation (%) | Elongation Difference (%) | Heater Temperature | Draw Ratio | $T_2/T_1$ | de | Flatness | de | Flatness | Filament Length Difference (%) | Alternately Twisted Yarn-like Wrapped Portion I | Entangled Portion II | Open Portion III | $L_2/L_1$ | Young's Modulus (kg/mm$^2$) | Evaluation of Woven Fabrics |
| Comparative Example 1 | 0.03 | 185 | 0.05 | 140 | 45 | 180 | 1.5 | 0.95 | 4.7 | 1.8 | 1.2 | 2.3 | 4 | x | o | o | 0.45 | 290 | paper-like touch, not substantially different from ordinary false-twisted yarn |
| Example No. 2 | 0.04 | 150 | 0.09 | 70 | 80 | 180 | 1.3 | 0.87 | 4.7 | 1.3 | 1.2 | 2.0 | 13 | o | o | o | 0.70 | 383 | soft worsted touch having good bulkiness (puff) and high resilience |
| Example No. 3 | 0.038 | 170 | 0.09 | 70 | 100 | 180 | 1.3 | 0.84 | 4.7 | 1.3 | 1.2 | 2.1 | 15 | o | o | o | 0.85 | 370 | soft worsted touch having good bulkiness (puff) and high resilience |
| Example No. 4 | 0.028 | 220 | 0.09 | 70 | 150 | 180 | 1.3 | 0.75 | 4.7 | 1.3 | 1.2 | 2.3 | 20 | o | o | o | 1.50 | 340 | soft worsted touch having good bulkiness (puff) and high resilience |
| Comparative Example No. 2 | 0.02 | 290 | 0.08 | 80 | 210 | 180 | 1.3 | 0.55 | 4.7 | 1.4 | 1.2 | 2.6 | 28 | o | slight | x | 2.35 | 290 | relatively poor resilience, short of softness and bulkiness |
| Comparative | 0.038 | 170 | 0.09 | 70 | 100 | 180 | 1.3 | 0.75 | 4.7 | 1.5 | 1.2 | 3.0 | 15 | o | o | slight | 0.26 | 360 | short of softness and bulki- |

TABLE 3-continued

| | Starting Yarns | | | | False-Twisting Conditions | | | | | | | | False-Twisted Yarns | | | | | | |
|---|---|---|---|---|---|---|---|---|---|---|---|---|---|---|---|---|---|---|---|
| | POY | | USY | | | | | | Large Denier Filaments | | Small-Denier Filaments | | | | | | | | |
| | Δn | Ultimate Elongation (%) | Δn | Ultimate Elongation (%) | Elongation Difference (%) | Heater Temperature | Draw Ratio | $T_2/T_1$ | de | Flatness | de | Flatness | Filament Length Difference (%) | Alternately Twisted Yarn-like Wrapped Portion I | Entangled Portion II | Open Portion III | $L_2/L_1$ | Young's Modulus (kg/mm$^2$) | Evaluation of Woven Fabrics |
| Example No. 3 | | | | | | | | | | | | | | | | | | | ness [rigid feel (roughness) by fusion bonding] |
| 4 | 0.038 | 170 | 0.09 | 70 | 100 | 180 | 1.3 | 0.84 | 6.0 | 1.6 | 1.2 | 2.1 | 15 | o | o | o–Δ | 0.65 | 424 | resilient but rough feel |
| Comparative Example No. 5 | 0.038 | 170 | 0.09 | 70 | 100 | 180 | 1.3 | 0.90 | 4.7 | 1.3 | 0.6 | 1.4 | 15 | o | o | o–Δ | 0.50 | 320 | strong oily touch (slime touch), not suitable as fabric having worsted fabric-like touch |

COMPARATIVE EXAMPLE 6

The procedures of Example 1 were repeated in the same manner except that, in the apparatus shown in FIG. 3, the members of from the feed roller 14 to the delivery roller 19 were arranged substantially on a straight line and the false-twisting was carried out without bending the yarn by the guide pins 16 and 17. In this operation, T1 was 45 g and T2/T1 was 0.62.

The major portion of the resultant false-twisted yarn was occupied by the alternately twisted yarn-like wrapped portion I and entangled portion II, and the open portion III was very small and L1/L2 was only ¼.

The evaluation of the woven fabric was carried out in the same manner as described in Example 1 by using the resultant false-twisted yarn. It was found that this comparative woven fabric had a high resilience but the softness and bulkiness were unsatisfactory.

EXAMPLE 5

The procedures of Example 1 were repeated in the same manner except that POY obtained from polyethylene terephthalate containing polyethylene glycol having an average molecular weight of 10,000 and sodium alkylsulfonate having 14 carbon atoms on the average in the alkyl group was used.

Note, the amounts of the polyethylene glycol and sodium alkyl-sulfonate were 1% by weight and 5% by weight based on the polyethylene terephthalate, respectively.

The resultant false-twisted yarn had a structure as shown in FIG. 1-(*a*), and the touch of a woven fabric obtained from this processed yarn was sufficiently soft and the fabric had a sufficient bulkiness and an appropriate resilience. Namely, the fabric had a touch like that of a worsted fabric.

When the antistatic property of the woven fabric was evaluated, it was found that the frictional charge voltage was 1855 V and each of the dust adherence and dust-removing property was class 4 to 5.

For comparison, POY not containing the polyethylene glycol and sodium alkyl-sulfonate was used. The frictional charge voltage was 3000 V and the dust adhesion and dust-removing property were both class 2.

INDUSTRIAL APPLICABILITY

The processed yarn of the present invention has a good softness, a good bulkiness (puff), and an appropriate resilience and is preferably used for the preparation of a medium-thickness woven fabric having a basis weight of 100 to 150 g/m$^2$. Furthermore, the processed yarn has a bundled portion X comprising an alternately twisted yarn-like wrapped portion I and an entangled portion II, which makes a great contribution to the touch, and by due to the presence of this bundled portion, even when the processed yarn is subjected to a water jet loom in the untwisted and size-free state, weaving can be performed without difficulty.

We claim:

1. A worsted yarn-like false-twisted yarn composed of at least two kinds of multi-filaments differing in denier, which filaments simultaneously satisfy (i) the requirement that the thickness of the large-denier filaments should be a least 4 de and (ii) the requirement that the thickness of the small-denier filaments should be 0.7 to 2 de, in which yarn bundled portions consisting of alternately twisted yarn-like wrapped portions and entangled portions, and open portions are alternately arranged along the longitudinal direction of the yarn, and wherein (A) in the alternately twisted yarn-like wrapped portions, a covering composed mainly of the small-denier filaments is wrapped substantially in a bundle form on a core portion composed mainly of the large-denier filaments, (B) in the open portions, a covering composed mainly of the small-denier filaments which are opened to one another covers a core composed mainly of the large-denier filaments substantially in parallel to the yarn axis in the successively reversed form, (C) the length (L1) of the open portions is at least ½ of the length (L2) of the bundled portions, and (D) in the unit length of the false-twisted yarn, the small-denier filaments are longer than the large-denier filaments and the difference in the length between the small-denier filaments and the large-denier filaments is 13 to 25% based on the length of the large-denier filaments.

2. A worsted yarn-like false-twisted yarn as set forth in claim 1, in which the cross-sectional profiles of the component filaments simultaneously satisfies (iii) the requirement that the degree of flatness of the large-denier filaments is lower than 1.5 and (iv) the requirement that the degree of flatness of the small-denier filaments is higher than that of the large-denier filaments.

3. A worsted yarn-like false-twisted yarn as set forth in claim 1, wherein the bundled portion and open portion are formed in an arrangement in the order of alternately twisted yarn-like wrapped portion — entangled portion — open portion.

4. A worsted yarn-like false-twisted yarn as set forth in claim 1, wherein the bundled portion and open portion are formed in an arrangement in the order of alternately twisted yarn-like wrapped portion — entangled portion — alternately twisted yarn-like wrapped portion — open portion.

5. A worsted yarn-like false-twisted yarn as set forth in claim 1, wherein the number of the bundled portions is 40 to 80 per meter.

6. A worsted yarn-like false-twisted yarn as set forth in claim 1, wherein the ratio (m1/m2) of the number (m1) of the open portions to the number (m2) of the bundled portion is from 0.6 to 1.4.

7. A worsted yarn-like false-twisted yarn as set forth in claim 1, wherein in the boundary between the core and covering (sheath) of the alternately twisted yarn-like wrapped portion, the filaments constituting the core and covering are mingled and entangled with one another.

8. A worsted yarn-like false-twisted yarn as set forth in claim 1, wherein the crimp wavelength of the small-denier filaments in the open portion is 0.5 to 1.5 mm as measured based on an optical microscope photograph at a magnification of 36.

9. A worsted yarn-like false-twisted yarn as set forth in claim 1, wherein the ratio (f1/f2) of the number (f1) of the thick-denier filaments to the number (f2) of the fine-denier filaments is from 1/10 to ½.

10. A worsted yarn-like false-twisted yarn as set forth in any of claims 1 through 9, wherein the total denier of the false-twisted yarn is smaller than 200 de.

* * * * *